US005385068A

United States Patent [19]

White et al.

[11] Patent Number: 5,385,068

[45] Date of Patent: Jan. 31, 1995

[54] ELECTRONIC ACCELERATOR PEDAL ASSEMBLY WITH PEDAL FORCE SENSOR

[75] Inventors: James E. White, Warsaw; John Zdanys, Jr., Elkhart, both of Ind.

[73] Assignee: CTS Corporation, Elkhart, Ind.

[21] Appl. No.: 993,141

[22] Filed: Dec. 18, 1992

[51] Int. Cl.[6] ..... G05G 1/14

[52] U.S. Cl. ..... 74/512; 74/513; 74/560

[58] Field of Search ..... 74/512, 513, 514, 560, 74/523, 533, 535

[56] References Cited

U.S. PATENT DOCUMENTS

| | | | |
|---|---|---|---|
| 2,192,714 | 3/1940 | Norman et al. | 137/139 |
| 2,207,435 | 7/1940 | Jones | 74/513 |
| 2,825,418 | 4/1958 | Kershman | 74/514 |
| 2,936,867 | 5/1960 | Perry | 74/513 |
| 3,088,331 | 5/1963 | Bachman | 74/513 |
| 4,047,145 | 9/1977 | Schwehr | 338/67 |
| 4,355,293 | 10/1982 | Driscoll | 338/184 |
| 4,528,590 | 7/1985 | Bisacquino et al. | 338/153 |
| 4,621,250 | 11/1986 | Echasseriau et al. | 338/162 |
| 4,693,111 | 9/1987 | Arnold et al. | 73/118.1 |
| 4,841,798 | 6/1989 | Porter et al. | 74/512 |
| 4,864,886 | 9/1989 | Burgei | 74/535 |
| 4,869,220 | 9/1989 | Imoehl | 123/399 |
| 4,881,424 | 11/1989 | Clark et al. | 74/523 |
| 4,944,269 | 7/1990 | Imoehl | 123/399 |
| 4,958,607 | 9/1990 | Lundberg | 74/513 X |
| 4,976,166 | 12/1990 | Davis et al. | 74/512 |
| 5,010,782 | 4/1991 | Asano et al. | 74/513 X |
| 5,133,225 | 7/1992 | Lundberg et al. | 74/560 |
| 5,133,321 | 7/1992 | Hering et al. | 123/399 |
| 5,211,072 | 5/1993 | Barlas et al. | 74/535 X |
| 5,217,094 | 6/1993 | Walter et al. | 74/535 X |

*Primary Examiner*—Vinh T. Luong
*Attorney, Agent, or Firm*—Albert W. Watkins

[57] ABSTRACT

A pedal bracket assembly translates pedal motion into a first switching motion without change of position being sensed by a position sensor. Additional pedal motion does not further change the switch position, but is translated into motion sensed by the position sensor. In this way, the switching function and position transducer functions are maintained independent one from the other, while allowing the two functions to be combined into a single sensor assembly.

7 Claims, 3 Drawing Sheets

ELECTRONIC ACCELERATOR PEDAL ASSEMBLY WITH PEDAL FORCE SENSOR

BACKGROUND OF THE INVENTION

1. Field of the Invention

This invention pertains generally to pedal brackets and more specifically to bracket structures cooperatively mated with electrical devices such as position sensors and force sensors.

2. Description of the Related Art

In the control of motors and machinery there are a number of interfaces that have been proposed through the years. These interfaces have sought to ease man's ability to perform the functions required in the operation of the machines with as little extraneous action and hardware as possible. In this way, an operator may perform as many functions as possible with minimal hinderance and with maximum control. That way, safety and efficiency are at a maximum.

One way of controlling a machine is with the use of pedals. These pedals allow input to the machine by use of an operator's foot, while simultaneously keeping hands free for other typically more complex tasks. These pedals are found in a variety of machines including pianos, sewing machines, and motive equipment such as automobiles and trucks.

The pedals used to control these devices in some cases are mechanical, typically incorporating a cable or various gears and other transmission devices to convert the limited rotary motion available from the pedal into useful mechanical motion to control the machine. Other pedals incorporate some type of position sensor that converts the mechanical position into an electrical signal. In the field of locomotion, particularly pertaining to automobiles and trucks, a mechanical bracket using a cable, often referred to as a Bowden cable, is the standard method for controlling the throttle of internal combustion engines. These pedal assemblies have a desirable feel and functionality and, with a few refinements, are extremely reliable. This type of pedal assembly defines many pedals today.

As noted above, through time there have been a number of attempts at different types of pedal devices to control machines. One major attempt has been to introduce an electrical linkage between the pedal and the device to be controlled. This is desirable since the gear assemblies are bulky, expensive and limited due to their inherent size to those applications where the pedal is very close to the controlled device. Mechanical linkages are not particularly flexible and are prone to sticking or binding. While the Bowden cable has proved generally reliable, the penetration of moisture and other contaminants may still cause the cable to bind. A cable less prone to failure is more expensive and bulky, and still inherently limited.

One early attempt at an electrical throttle controller is illustrated in U.S. Pat. No. 2,192,714. Therein, the throttle valve of an internal combustion engine could be controlled either by foot using a pedal or by hand using a knob. A second construction, illustrated for use with a forklift, is disclosed in U.S. Pat. No. 4,047,145. This second construction offers an ability to adjust the device for variances in manufacturing and performance among various assemblies.

More recently, there have been proposed devices that offer added safety features. This appeal is readily understood in view of the potential for harm of a several tone vehicle irreversibly set to full throttle. Even momentary loss of control, such as might occur with the false transmission of acceleration while in a line at a stoplight, may result in substantial damage. There has been sought a way to offer the desirable feel of the Bowden cable while improving reliability to ensure the safety of an operator and associated equipment. Heretofore, such a combination of features was not available for a price competitive with the Bowden cable.

In an effort to obtain the desired reliability, dual functions have been proposed in the prior art. The first of these is a pedal force switch or, performing a similar function, an idle validation switch. Exemplary patents illustrating such a combination are U.S. Pat. Nos. 5,133,225 and 4,869,220. However, each of these prior art patents forces movement of the position sensor to occur together with activation of the switch. Such a limitation does not allow for totally separate and independent functioning of the two devices and can lead to undetected failure modes. As noted, such undetected failure modes can cause much damage and may even lead to fatalities. The present invention seeks to overcome the limitation of the prior art.

SUMMARY OF THE INVENTION

The present invention overcomes the limitations of the prior art by incorporating a dual pivot structure into the pedal assembly. A first bracket provides rigid support for the entire pedal assembly and has extending therethrough a generally cylindrical shaft. About this shaft a second rotary moving bracket is supported that carries a combination of springs, hysteresis assembly, position sensor and force switch. The switch and sensor, while carried in one package, are actuated independently one from another, providing a ready way to validate correct operation of each device.

DESCRIPTION OF THE PREFERRED EMBODIMENT

Figure 1:
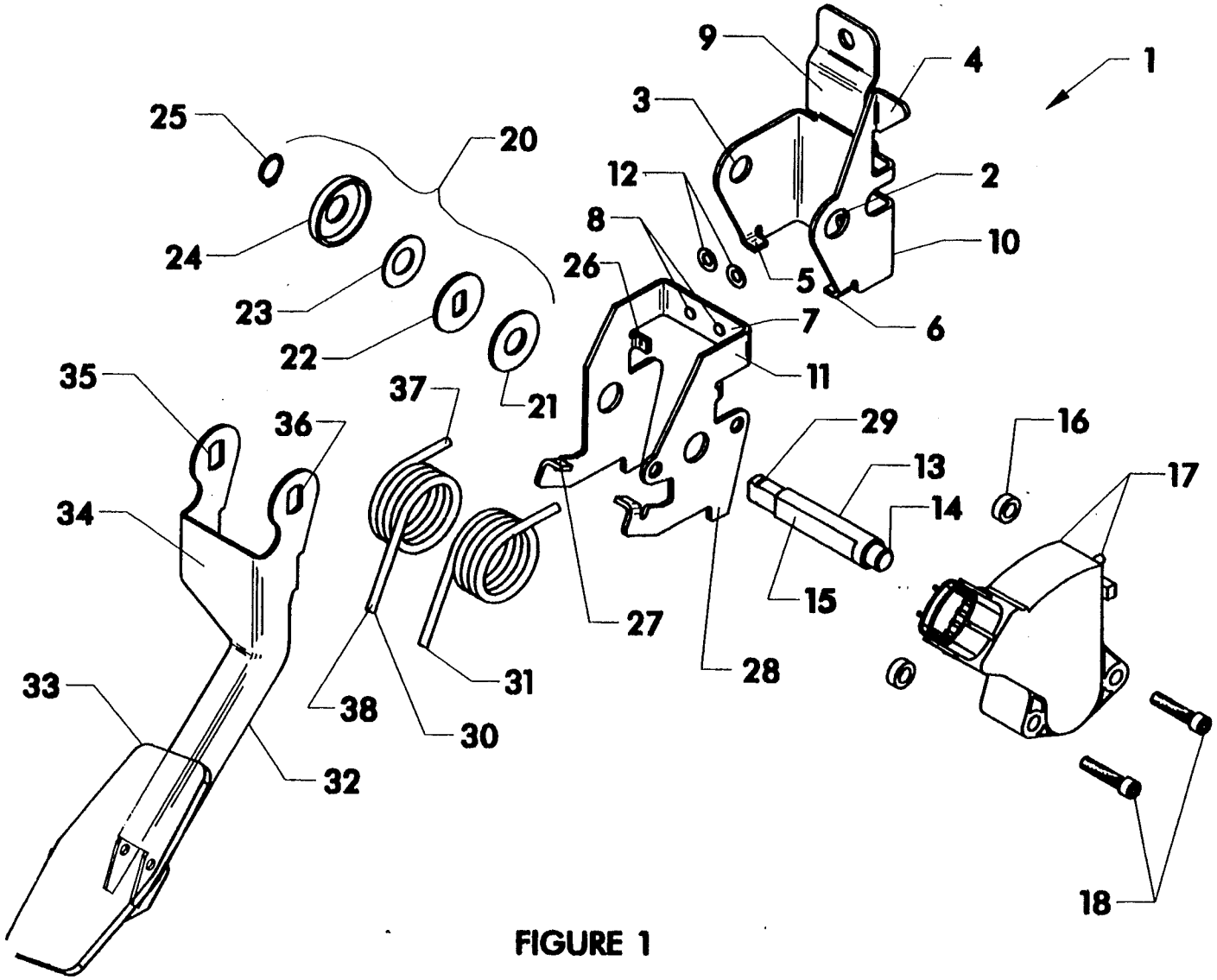
FIG. 1 illustrates by exploded view a preferred embodiment of the entire pedal assembly.

FIG. 1 illustrates the preferred embodiment of the electronic accelerator pedal assembly, by exploded view for clarity. The entire assembly 1 is supported by rigid pedal mounting bracket 10 that is affixed by bolt of other similar fastening structure to a suitable support such as bulkhead of an automobile (not illustrated). Rigid bracket 10 should be firmly supported so as to not move relative to the support. Rigid bracket 10 has coaxial openings 2 and 3 therein which receive shaft 13 therethrough. Between openings 2 and 3 and similarly supported upon shaft 13 is moving bracket 11. Moving bracket 11 has a U-shaped surface 7 interconnecting like surfaces of moving bracket 11. Formed into U-shaped surface 7 are two locating dimples 8 which serve to locate belleville spring washers 12. These belleville washers 12 are retained between U-shaped surface 7 and rigid bracket 10 at the slightly contoured or shaped region 9. To build the assembly 1, moving bracket 11 is positioned with torsion spring retention tabs 26 on the surface of shaped region 9 closest to coaxial openings 2 and 3. U-shaped surface 7 with dimples 8 and belleville spring washers 12 are then slid over the side of shaped region 9 so as to interact therewith on the surface of region 9 away from openings 2 and 3. Once assembled, a viewer looking from the angle of FIG. 1 will not be able to see U-shaped region 7, dimples 8 and belleville washers 12 due to shaped region 9 blocking the view.

Similarly supported upon shaft 13 is pedal arm 32, carrying therewith pedal pad 33. Not illustrated is the pivot pin and spring commonly associated with the pedal pad, allowing pedal pad 33 to pivot on arm 32, as these form no material part of the invention. Pedal arm 32 is carried upon shaft 13 through coaxial openings 35 and 36. Openings 35 and 36 are illustrated as generally rectangular in shape so as to engage flats 15 of shaft 13. Rotation of pedal arm 32 about shaft 13 therefore will also rotate shaft 13. The nature of the interconnections is not limiting, and may take any desirable form including but not limited to mating geometries, welded or brazed connections, or similar arrangements. This particular rectangular mating relationship between openings 35 and 36 and shaft 13 is preferred due to ease of manufacture and replacement.

Carried about shaft 13, but not generally engaged therewith, and also between openings 35 and 36 are the two torsion springs 30 and 31. A first end 37 of torsion spring 30 will press against tab 26 when spring 30 is installed, under slight compressive force. A second end 38 of spring 30 will press against the side of flat 34 not visible in FIG. 1, thereby forcing flat 34 of pedal arm 32 against stop 27. Torsion spring 31 is similarly installed. Duplication of function is achieved in the structure through the use of spring 31 with spring 30 and two spring washers 12. Failure of one of the pairs, or even one torsion spring and one spring washer will not disable the assembly. However, one or more springs could be used. Duplication is preferred.

Also carried on shaft 13 is the mechanical hysteresis mechanism 20 that produces the feel of the Bowden cable familiar to automobile drivers. Friction pad 21 mounts against bracket 10 and serves to provide a controlled friction with washer 22. Washer 22 is illustrated with a mating geometry similar to openings 35 and 36, so as to be rotated simultaneous with shaft 13. Rotary motion of shaft 13 is thereby retarded somewhat by the friction between washer 22 and pad 21, wherein pad 21 remains substantially anchored with bracket 10. Belleville spring washer 23, cap 24 and retaining ring 25 combine to maintain force through washer 22 and against pad 21. Flat 15 does not extend the full length of shaft 13, and at the termination nearest drive 14 allows shaft 13 to engage against the opening through bracket 11. This counterbalances the force applied on shaft 13 by belleville spring washer 23. Drive 14 engages with position sensor 17 to rotate drive arms 52 and 53 (shown in FIG. 3) upon rotation of shaft 13 relative to moving bracket 11. Position sensor 17 is retained to moving bracket 11 through bolts 18 and is therefore only actuated upon rotation of shaft 13 relative to moving bracket 11.

Figure 2:
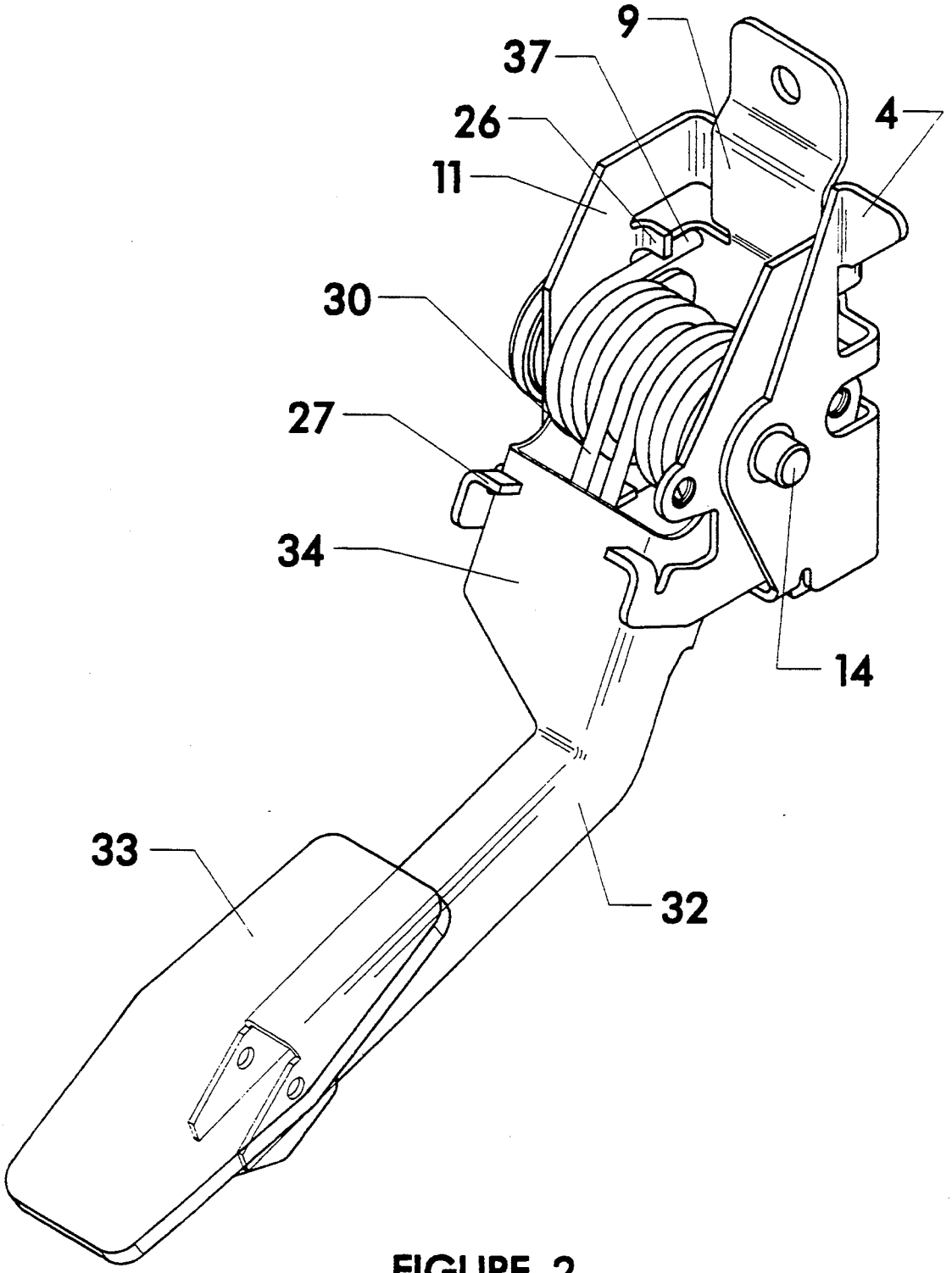
FIG. 2 illustrates the preferred embodiment in an assembled view ready for mounting.

FIG. 2 shows assembly 1 ready for installation. Like elements are so numbered where visible. The completed assembly 1 as illustrated might be installed along the bulkhead dividing a passenger compartment from an engine area in an automotive or truck application, or might be installed upon a structure specifically built to provide rigid support for assembly 1.

Figure 3:
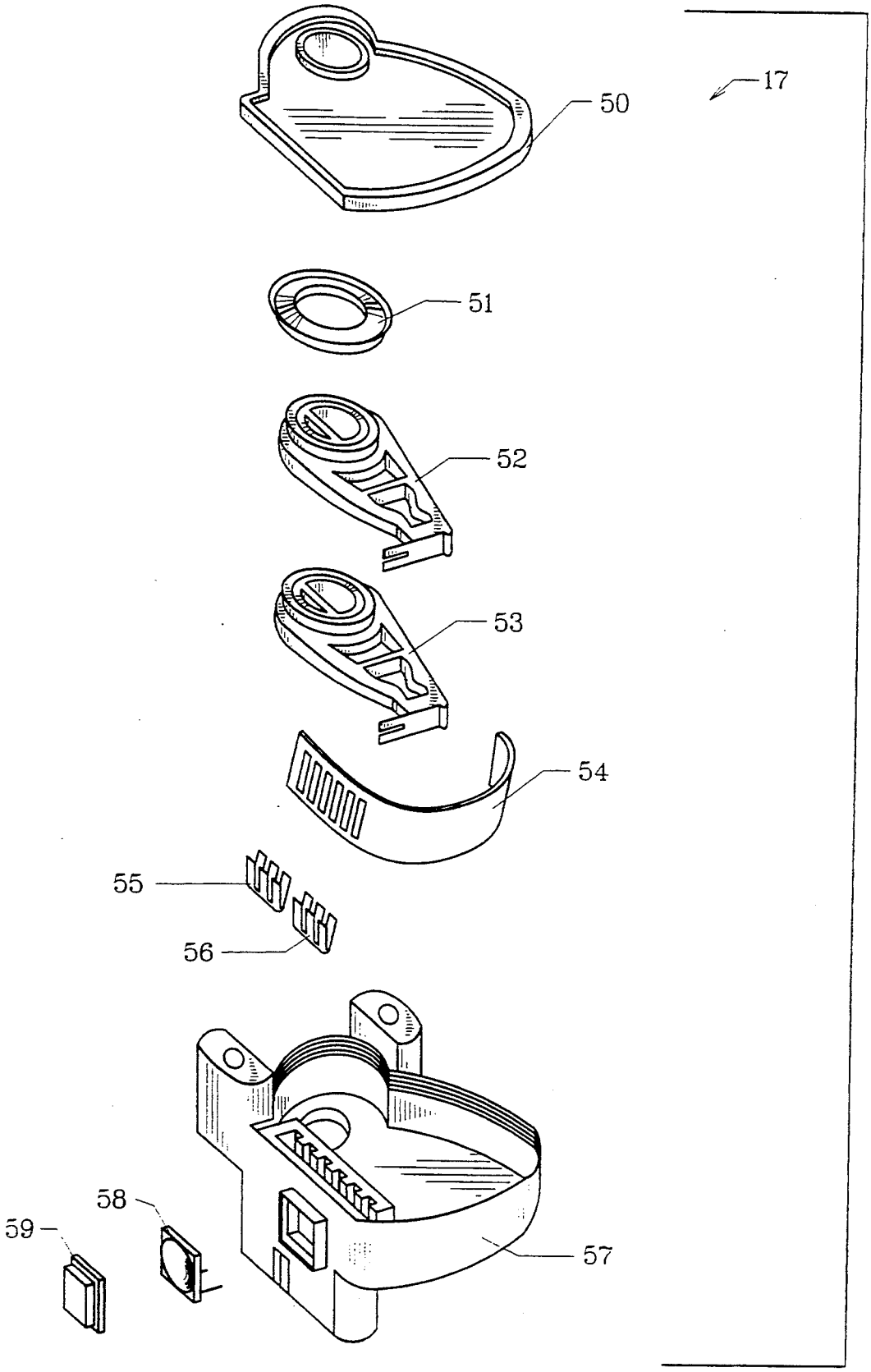
FIG. 3 illustrates by exploded view a preferred embodiment of a pedal position sensor combined with a pedal force switch.

FIG. 3 illustrates a preferred embodiment for the combined position sensor and switch assembly 17. As shown, the complete assembly 17 is generally surrounded by housing 57 and cover 50. Therein may also reside seal 51 to prevent the entry of foreign elements otherwise detrimental to the assembly, and rive arms 52 and 53. These drive arms are adapted to be pressed directly onto shaft 13 at drive 14, for direct mechanical engagement and rotation therewith. Alternatively, there may be additional structure as known in the prior art and not illustrated herein to provide for positive coupling therebetween. While there are two drive arms 52 and 53 illustrated, note that there may be any number from one or more, although two is preferred for duplication of function and yet low cost. The interconnections between drive arms 52 and 53 and shaft drive 14 are not illustrated in great detail and will be well known to one of ordinary skill. Exemplary patents, though not the only ones, are U.S. Pat. Nos. 4,355,293, 4,621,250 and 4,693,111 incorporated herein by reference. These drive arms 52 and 53 may be designed to mate one with the other and rest upon a rotary bearing surface at the base of housing 57. The mating features are not illustrated herein, through one or ordinary skill will recognize that mating concentric cylinders coaxial with the shaft 13 would provide one means of accomplishing the function. Drive arms 52 and 53 might be combined into one rigid structure and may have two contacts at the ends thereof. Other suitable structures are well known to those of ordinary skill in the art as noted above.

For the sake of illustration, flexible element 54 similar to that shown in U.S. Pat. No. 4,355,293 is retained in place by features not shown in housing 57 and pressure wedges 55 and 56. Attached on a side of housing 57 and forming the novel feature of assembly 17 is a switch 58 enclosed by actuator 59. Prior art switch and sensor combinations rely upon the same rotational shaft to actuate both the position sensor and the switch. In some instances the switch is even formed as a separate very short resistor element upon the same flexible film as the sensor. This type of assembly is inherently limited for several important reasons. Using the shaft to actuate both position and sensing functions forces the position sensor to travel a certain limited distance prior to switch actuation. This movement either is indicated as a change or non-zero position by the position sensor. Even where there is a large area of conductive patterned for the position sensor to slide upon during switch actuation, the conductive does have finite resistance and a change in resistance will be conveyed. Further, if the shaft should bind with the sensor, there is no way to verify whether there is intent to actuate the shaft. In some prior art applications, there has been an effort to separately package the switch and the sensor. This results in a more expensive package and spreads wiring over a greater distance—exposing the assembly to greater risk of damage or external interference.

Switch 58 is illustrated herein as a dome switch, but other types of switches and even electronic switching devices such as Hall effect sensors are contemplated. Similarly, other constructions of sensors are also contemplated and very much within the scope of this invention. The fact that switch actuator 59, radially disposed from shaft 13, is actuated without rotation of shaft 13 relative to assembly 17 is very important to this invention.

In operation of assembly 1, torsion springs 30 and 31 are under slight compressive force when no pressure is applied to pedal pad 33. Upon application of a small force upon pad 33, indicative of demand for throttle in the application of this invention to automobile accelerators, the force is transmitted through a second end 38 of torsion spring 30 to the first end 37 and into moving bracket 11. This causes moving bracket 11 to rotate on shaft 13 relative to rigid bracket 10, thereby compressing belleville washers 12 which have a lower compressive force than torsion springs 30 and 31. At this time, there is no compression of torsion springs 30 and 31. Dimples 8 are most preferably formed to be no larger than the thickness of the thinnest portion of spring washers 12, so to not interfere with the operation of the moving bracket 11 and belleville spring washers 12.

Compression or flattening of belleville spring washers 12 causes the entire moving bracket 11 and all parts supported thereon to rotate slightly relative to rigid bracket 10. This slight rotation is sensed by a switch 58 mounted on the side of sensor 17 and best illustrated in FIG. 3. The rotation causes housing 57 to move away from lip 4 of bracket 10. Actuator 59 normally is pressed tightly against lip 4 by the force of belleville spring washers 12. Movement of housing 57 away from lip 4 releases pressure from switch 58 to cause a switching action to occur. This switching action occurs regardless of whether the remainder of sensor 17 is operational, bound up, or otherwise non-functional, provided electrical connection exists. In this way, demand for throttle may be sensed independent of pedal position.

Since sensor 17 is retained to moving bracket 11 through bolts 18, no change in position relative to housing 57 occurs in position sensor drive arms 52 and 53 until shaft 13 rotates relative to moving bracket 11.

While the foregoing details what is felt to be the preferred embodiment of the invention, no material limitations to the scope of the claimed invention is intended. Further, features and design alternatives that would be obvious to one of ordinary skill in the art are considered to be incorporated herein. The scope of the invention is set forth and particularly described in the claims hereinbelow.

We claim:

1. A bracket assembly carrying an actuator means comprising:

a means for supporting a moving bracket means and locating a rotational axis, said moving bracket means occupying a first position relative to said supporting means when no force is applied to said actuator means;

a connecting means connecting said actuator means to said moving bracket means, said connecting means operative upon application of a first force to said actuator means to move said moving bracket means relative to said support to a second position without relative movement between said actuator and said moving bracket means, and upon application of a second force greater in magnitude than said first force to said actuator to rotate said moving bracket to said second position without relative movement between said actuator and said moving bracket means, and to subsequently move said actuator means relative to said moving bracket means;

said moving bracket means and said supporting means spaced from each other by a spring means.

2. The bracket assembly of claim 1 wherein said spring means comprises a belleville washer.

3. The bracket assembly of claim 1 wherein said connecting means comprises a resilient means.

4. The bracket assembly of claim 1 wherein said connecting means comprises a resilient means.

5. The bracket assembly of claim 4 wherein said resilient means requires more force to deform than said spring means.

6. The bracket assembly of claim 1 wherein said spring means is spaced from said actuator means by said moving bracket means.

7. The bracket assembly of claim 1 wherein said actuator means comprises a pedal.

* * * * *